US009629480B2

(12) United States Patent
Ewing et al.

(10) Patent No.: US 9,629,480 B2
(45) Date of Patent: Apr. 25, 2017

(54) MERCHANDISE PUSHER TRAY WITH ADJUSTABLE SIDE BARRIERS

(71) Applicants: Brent Ewing, Roscoe, IL (US); Thomas O. Nagel, Rockford, IL (US); Alex Souhala, Rockford, IL (US)

(72) Inventors: Brent Ewing, Roscoe, IL (US); Thomas O. Nagel, Rockford, IL (US); Alex Souhala, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 14/795,988

(22) Filed: Jul. 10, 2015

(65) Prior Publication Data

US 2017/0007038 A1 Jan. 12, 2017

(51) Int. Cl.

| | |
|---|---|
| ***A47F 1/12*** | (2006.01) |
| ***A47B 57/52*** | (2006.01) |
| ***A47B 57/42*** | (2006.01) |

(52) U.S. Cl.

CPC ..... *A47F 1/126* (2013.01); *A47B 57/42* (2013.01); *A47B 57/52* (2013.01); *A47F 1/125* (2013.01); *A47F 1/128* (2013.01)

(58) Field of Classification Search

CPC ..... A47F 1/126; A47F 1/125; A47F 1/128; A47B 57/42; A47B 57/52

USPC ..... 211/59.3, 192; 248/222.11–222.13

See application file for complete search history.

(56) References Cited

U.S. PATENT DOCUMENTS

| | | | | |
|---|---|---|---|---|
| 3,869,031 | A * | 3/1975 | Coleman | B65G 13/12 193/35 R |
| 6,866,156 | B2 * | 3/2005 | Nagel | A47F 1/126 211/59.3 |
| 7,628,282 | B2 | 12/2009 | Hardy | |
| 7,823,834 | B2 | 11/2010 | French | |
| 8,720,702 | B2 * | 5/2014 | Nagel | A47B 96/027 211/193 |
| 9,232,864 | B2 * | 1/2016 | Hardy | A47B 87/0246 |

* cited by examiner

*Primary Examiner* — Korie H Chan

(74) *Attorney, Agent, or Firm* — Reinhart Boerner Van Deuren P.C.

(57) ABSTRACT

A merchandise pusher tray is provided. The merchandise pusher tray includes a first and second support structure. The first and second support structures provide support for a base structure. The first and second support structures couple to a support bracket. The support bracket holds the first and second support structures and the base structure in a cantilevered position when mounted to a bar or shelf. The merchandise pusher tray may include a divider. The divider can be coupled to the base structure and adjustable along a second axis relative to the base structure. The merchandise pusher tray further includes a pusher that is mounted to the base structure and capable of movement along a first axis relative to the base structure.

21 Claims, 12 Drawing Sheets

MERCHANDISE PUSHER TRAY WITH ADJUSTABLE SIDE BARRIERS

FIELD OF THE INVENTION

This invention generally relates to retail merchandise displays, and more specifically to self-facing retail merchandise displays.

BACKGROUND OF THE INVENTION

Self-facing retail merchandise displays are generally known in the art for example U.S. Pat. No. 8,720,702 to Nagel; U.S. Pat. No. 7,823,734 to Hardy; U.S. Pat. No. 7,628,282 to Hardy, the entire disclosures of which are hereby incorporated by reference. An example of such a self-facing retail display is the pusher system. A typical pusher system has a track and a pusher body connected to a spring located at the leading edge of the track. The spring exerts a linear force on the pusher body that causes the pusher to move in a linear direction towards the leading edge of the track.

In use, a linear force is applied to the pusher body, which causes the pusher body to move away from the leading edge of the track. As the linear force is applied it causes the spring to coil relative to the amount of force applied to the pusher body. After applying enough force to relocate the pusher body to the desired location on the track, the user can load retail merchandise on the track between the pusher body and the leading edge of the track. The user can then release the pusher body, which causes the coiled spring to recoil and exert a second linear force on the pusher body. The second linear force exerted by the spring drives the pusher body forward to contact the retail merchandise and apply a biasing force on the retail merchandise. The biasing force exerted by the spring and applied by the pusher body causes the retail merchandise to "front-face" on the retail display.

For example, as a customer selects a piece of merchandise from the track, it forms a gap between the leading edge of the track and the linear row of retail merchandise. This causes the spring to exert a linear force on the pusher body, which in turn causes the pusher body to exert a biasing force on the linear row of merchandise. The biasing force exerted by the pusher body on the merchandise causes the merchandise to "front-face" by shifting forward and abutting the leading edge of the track.

The automatic front-facing of retail merchandise serves the dual purpose of making the merchandise look aesthetically pleasing, while also reducing the number of man-hours allocated to front-facing retail merchandise. In sum, self-facing retail merchandise displays make the merchandise aesthetically pleasing, which increases sales, and reduces the number of man-hours dedicated to front-facing merchandise, which improves efficiency.

The pusher system described above can be employed in a variety of retail settings using a variety of retail displays. For example, self-facing merchandise displays are commonly installed side-by-side on retail shelving and separated by dividers that keep the merchandise in generally straight rows along the depth of the shelving. Retail stores commonly employ such a system to sell deodorant or other hygienic products.

Although, the pusher system described above has many advantages it is not without its faults. There are certain retail environments, such as commercial refrigerated cabinets or freezers, which have not been able to realistically incorporate conventional retail pushers. One reason for this is that conventional pusher systems do not optimize the finite amount of space available in commercial refrigerators or freezer. As such, many retailers choose not to install conventional pusher systems in their freezers and refrigerators because they are unwilling to sacrifice valuable retail display space to provide room for conventional retail pusher systems.

Another common problem is the mechanical failure or jamming of conventional pusher systems caused by the low temperatures required to safely display refrigerated or frozen foods. The mechanical failure of conventional retail pusher systems is often caused by ice buildup within the refrigerated cabinets or freezers. As ice builds in the refrigerated cabinets or freezers it also builds on the moveable parts of conventional pusher systems, which can cause conventional pusher systems to jam.

Additionally, conventional pusher systems typically use hooks to attach to mount shelving typically found in commercial refrigerated cabinets or freezers. The hooks of conventional pusher systems typical hang from mount shelving and the weight of the retail merchandise sitting atop the conventional pusher system exerts a downward force on the hooks, which secures the hooks from moving along the mount shelving. Such a design makes conventional pusher systems susceptible to dislodging from the mount shelving. This is especially true when the pusher tray is not fully loaded with merchandise and there is no downward force being applied by the weight of the retail merchandise to keep the hooks secure to the mounting shelf. A problem can occur if a hook dislodges before loading because it can cause the immediate collapse of the system. Likewise, even if one of the hooks is dislodged or partially dislodged the weight of a load of retail merchandise will strain the hooks. Over time, the strain on the hooks causes them to deform, in which case the retailer has to incur the cost of replacing the hooks or the entire pusher system. In addition, the deformation of the hooks raises safety concerns for retailers due to the fact customers and employees routinely place their hands and arms below loaded pusher systems to restock or select retail merchandise. As a result, many retailers have not incorporated conventional pusher systems into their stores due to the financial and safety concerns raised above.

Furthermore, it is common to mount shelving in commercial refrigerated cabinets or freezers along mounting bars that run horizontally along the backside of the cabinets or freezers. This results in commercial refrigerated cabinets or freezer typically having cantilevered shelving extending from the backside of the horizontal mounting bars located on the backside of the cabinet or freezer. The weight of the shelving in addition to the merchandise placed on the shelving will often times bend the shelving. This has proven to be problematic for conventional pusher systems because they incorporate an array of moving parts optimized to work while level.

Accordingly, there is a need in the art for a pusher system that can be readily incorporated into a refrigerated cabinet or a freezer and maximize the limited amount of space available; is prevented from inadvertently dislodging from mount shelving; and remain as a cantilevered extension even while holding heavy loads of retail merchandise for extended periods of time.

The invention provides such a system. These and other advantages of the invention, as well as additional inventive features, will be apparent from the description of the invention provided herein.

BRIEF SUMMARY OF THE INVENTION

In one aspect, a merchandise pusher tray is provided. An embodiment of the merchandise pusher tray according to this aspect includes a base structure having a first and second support structure in opposed spaced relationship. The pair of support structures act as a support surface to carry the retail merchandise. The first and second support structures have a pusher interposed between them that is capable of movement along a first axis of the base structure. Further provided, is at least one divider that is mounted to the base structure and is capable of movement along a second axis that runs generally perpendicular to the first axis. The first and second support structures have an aperture, which couples the first and second support structures to a support bracket. The support bracket has a horizontal top plate in which a first and second sidewall depends. The support bracket is capable of mounting to a generally vertical wall, thereby supporting the first and second support structures, base structure, pusher, and retail merchandise from the generally vertical wall in a cantilevered extension. The support bracket coupled to the base structure, the support bracket defining a downwardly facing opening situated below the retail merchandise support surface supported by the first and second support structures.

In yet another aspect, a merchandise pusher tray is provided. An embodiment of a merchandise pusher tray according to this aspect includes a base structure that includes a floor carried by the first and second support structures. The floor defines a support surface configured to carry retail merchandise thereon. In certain embodiments, the floor is a welded wire assembly including a plurality of longitudinal wires and a plurality of transverse wires joined to each of the plurality of longitudinal wires. In certain other embodiments, there may be an upturned end for receiving a front stop on at least one of the plurality of longitudinal wires.

In yet another aspect, a merchandise pusher tray is provided. An embodiment of a merchandise pusher tray according to this aspect includes a first and a second divider arranged in an opposed spaced relationship that define a channel to hold retail merchandise. The channel has a width that is variable depending on the adjusted position of the first and second divider. In certain other embodiments, the first and second divider may include a first and second extension that extends from a side of the first and second divider and into the base structure. In certain embodiments, the first and second extensions of the first and second divider may extend into a front and a rear spacer mounted to the base structure between the first and second support structures.

In another aspect, a merchandise pusher tray is provided. An embodiment of a merchandise pusher tray according to this aspect includes a base structure. The base structure includes a first and a second support structure. This embodiment of the merchandise pusher tray also includes a pusher slideably mounted to the base structure. In addition, a first and a second moveable divider are coupled to the base structure. The first and the second moveable dividers define the width of a merchandise retail channel that is variable depending upon the adjustment of the first and second moveable divider where the width of the retail merchandise channel is variable in a direction perpendicular to a direction of movement of the pusher.

In yet another aspect, a merchandise pusher tray is provided. An embodiment of a merchandise pusher tray according to this aspect includes a base structure that provides a retail support surface for carrying and retaining merchandise thereon. A pusher is slideably mounted to the base structure and is slideable along a first axis.

In yet another aspect, a merchandise pusher tray is provided. An embodiment of a merchandise pusher tray according to this aspect includes a base structure including a first and second support structure arranged in an opposed spaced relationship and a pusher slidably mounted to the base structure. The first and second support structures couple with the support bracket. In certain embodiments, the first and second divider are moveable along a second axis to define the width of a merchandise retaining channel, whereby the width of the merchandise retaining channel is variable based upon adjustment of the first and second divider.

In yet another aspect, a merchandise pusher tray is provided. An embodiment of a merchandise pusher tray according to this aspect includes a base structure that is a wire floor having a plurality of longitudinal members and a plurality of horizontal members. In certain embodiments, the plurality of longitudinal members are welded to the plurality of transverse members.

In yet another aspect, a merchandise pusher tray is provided. An embodiment of a merchandise pusher tray according to this aspect includes a pusher having at least one aperture that receives and retains a longitudinal member of the wire floor. The pusher having a linear motion bearing vertically extending from the pusher that encloses the longitudinal member of the wire floor within the aperture of the pusher, whereby the pusher can move along a first axis relative to the base structure.

In yet another aspect, a merchandise pusher tray is provided. An embodiment of a merchandise pusher tray according to this aspect includes a divider having a wire structure.

In yet another aspect, a merchandise pusher tray is provided. An embodiment of a merchandise pusher tray according to this aspect includes a base structure including a first and a second support structure arranged in an opposed space relationship. The first and second support structures provide a surface to hold retail merchandise. The surface holds a pusher that is slidable along a first axis relative to the surface. The first and second support structures couple to a support bracket having a horizontal top plate in which a first and a second sidewall depend. The support bracket acts to define a channel configured for receiving a retail display bar, the channel extending between the first and second support structures.

In yet another aspect, a merchandise pusher tray is provided. An embodiment of a merchandise pusher tray according to this aspect includes a locking bar. The locking bar has a locking button. The first sidewall having a first and second aperture through the first sidewall and allowing access to the downwardly facing notch of the support bracket. The locking button partially projecting through the first aperture into the downwardly facing notch of the support bracket. The locking bar riveted to the first side wall.

In yet another aspect, a merchandise pusher tray is provided. An embodiment of a merchandise pusher tray according to this aspect includes an aperture in the second sidewall. The aperture located across the downward facing notch from the rivet, whereby the first aperture of the second sidewall allows a user to access the locking button partially projecting from the first sidewall.

In yet another aspect, a merchandise pusher tray is provided. An embodiment of a merchandise pusher tray where the support bracket is mounted to a generally vertical wall, while the support bracket maintains the base structure as a cantilevered extension.

In yet another aspect, a merchandise pusher tray is provided. An embodiment of a merchandise pusher tray according to this aspect includes the first and second support structures welded to the support bracket.

In yet another aspect, a merchandise pusher tray is provided. An embodiment of a merchandise pusher tray according to this aspect includes the support bracket mounted to a generally vertical wall, where the first and the second support structures maintain the base structure as a cantilevered extension while holding between 55-99 lbs. of retail merchandise.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
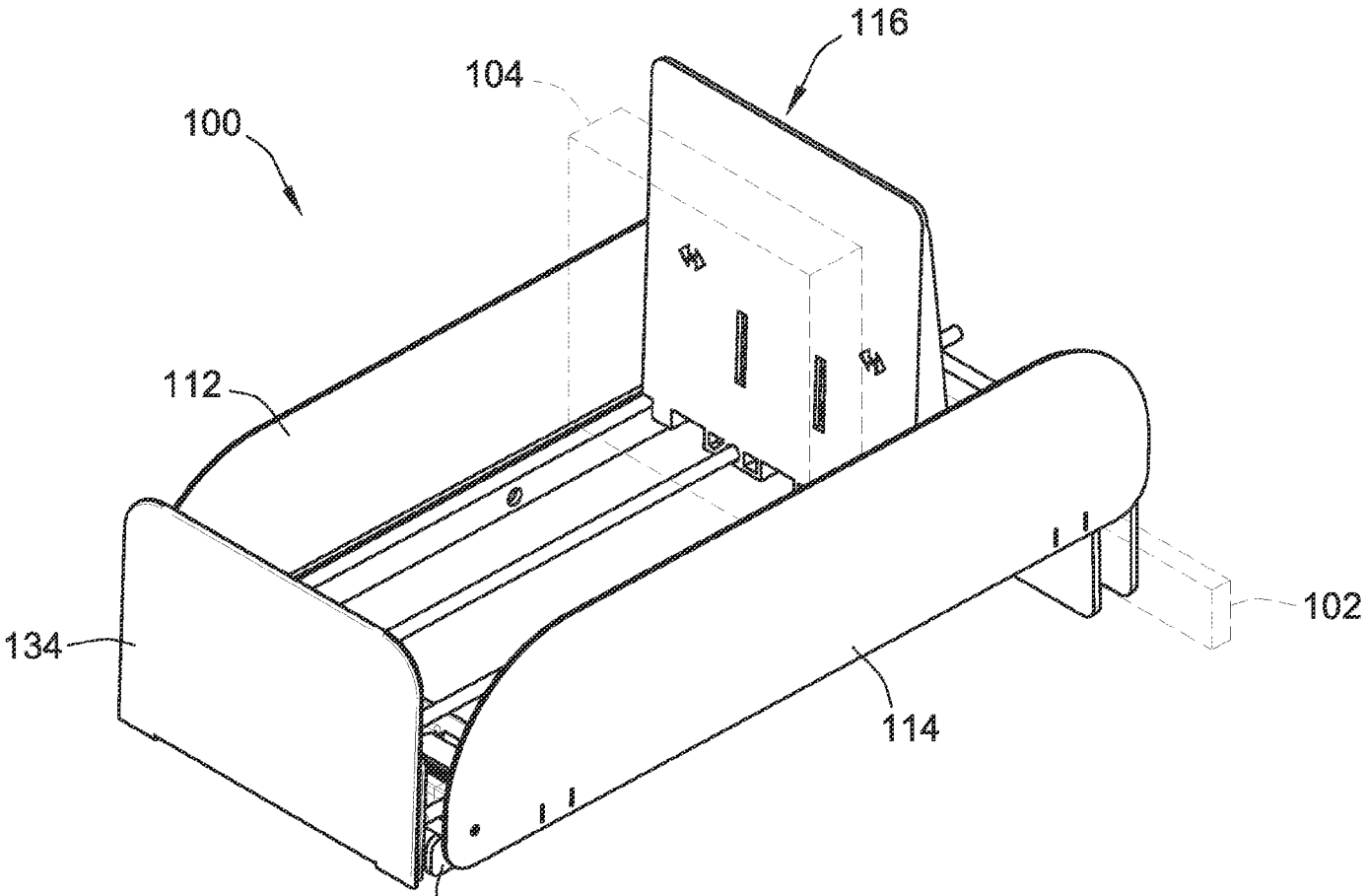
FIG. 1 is a perspective view of an embodiment of a bar mounted merchandise tray with adjustable side barriers according to the teachings of the present invention.

Turning now to the drawings, FIG. 1 illustrates an exemplary embodiment of a merchandise pusher tray with adjustable side barriers 100 (herein "tray"). The tray 100 can be mounted to a retail display bar 102 that is typically found in commercial refrigerators or freezers, as illustrated in FIG. 1. As illustrated, tray 100 can operate to bias retail merchandise 104 forward in a front-facing manner. FIG. 1 illustrates tray 100 as it can typically be found in a commercial refrigerator or freezer. However, one of ordinary skill in the art will recognize that the tray 100 can be used in other environments in addition to commercial refrigerators and freezers. For example, one of ordinary skill in the art will readily recognize the inventions application in other retail settings such as dry good shelving, store counter shelving, and cosmetic shelving etc.

Figure 2:
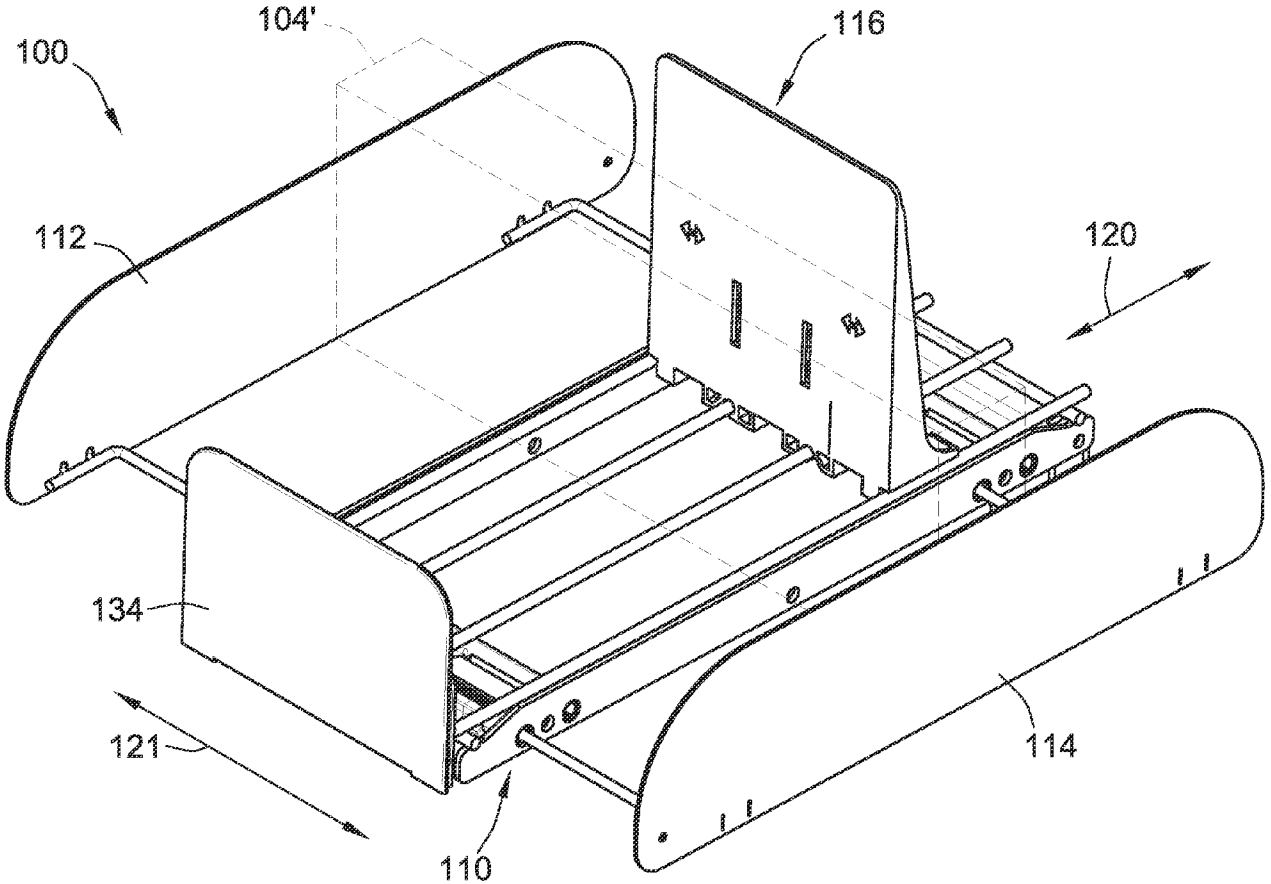
FIG. 2 is a perspective view of the tray of FIG. 1, illustrating a first and second divider and a pusher and their respective motions relative to the tray.

Turning to FIG. 2, tray 100 includes a base structure 110. Mounted to the base structure 110 is a pusher 116 and a first and second moveable divider 112 and 114. The first and second divider 112 and 114 are capable of independent movement along a second axis 121 relative to the base structure 110. This allows the user to adapt the width of the retail merchandise channel corresponding to varying widths of retail merchandise 104'. Thus, by increasing or decreasing the particular spacing of the first and second divider 112 and 114 a single tray 100 can accommodate retail merchandise 104' having varying sizes.

Figure 13:
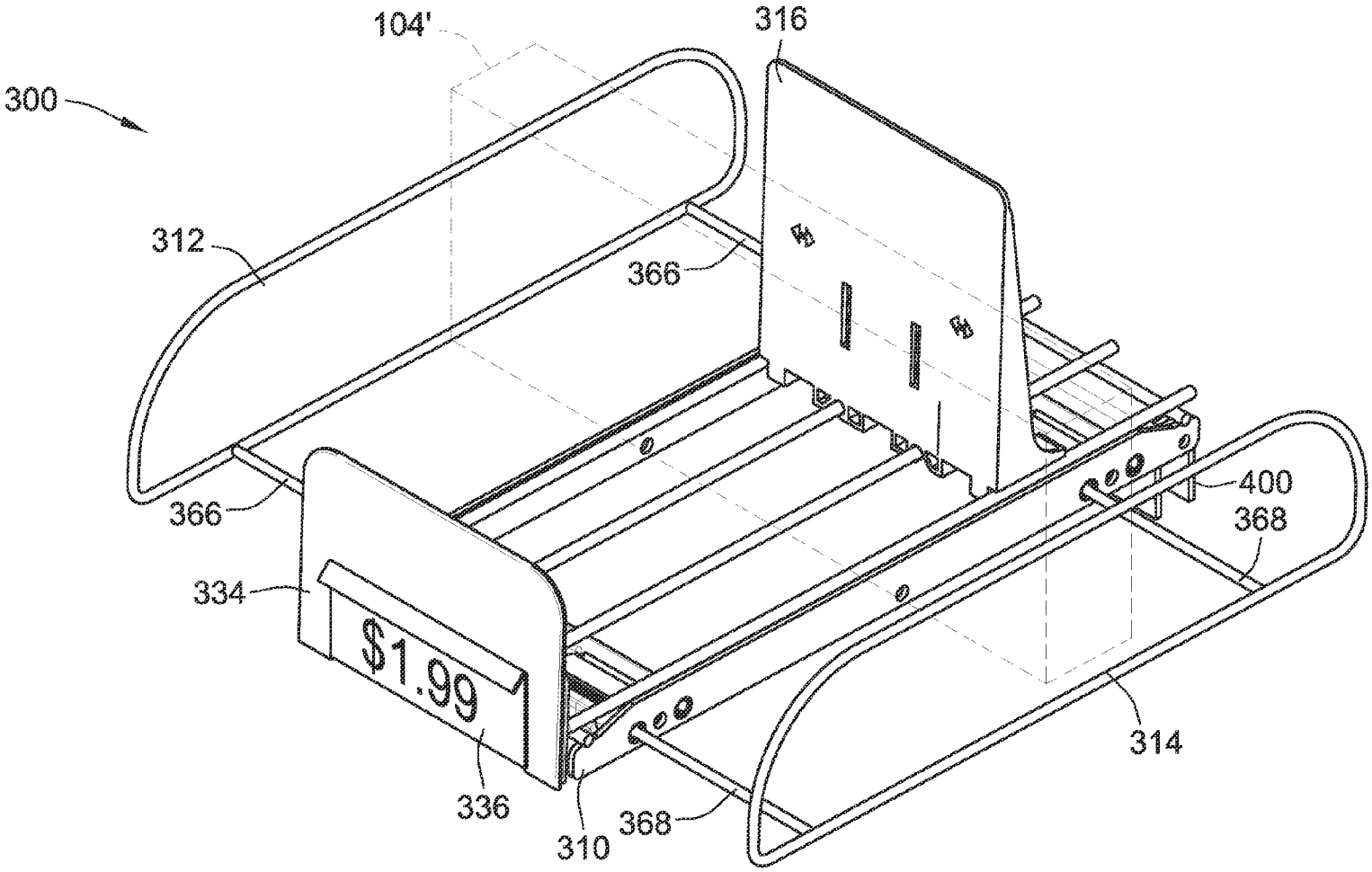
FIG. 13 is a perspective view of a second embodiment of a merchandise pusher tray with a first and second adjustable divider according to the teachings of the present invention.

In addition, the first and second divider 112 and 114 can take the form of any barrier style or configuration sufficient to define the area for containing the specific retail merchandise 104. For example, the pair of dividers 112 and 114 can take the form of a plate-like structure, as best illustrated in FIGS. 1-2, or they may be a wire structure as illustrated in FIG. 13, etc.

As best illustrated in FIG. 2, the pusher 116 is moveable along a first axis 120 relative to the base structure 110. The movement of the pusher 116 along the first axis 120 acts to front face retail merchandise, as described herein.

Figure 3A:
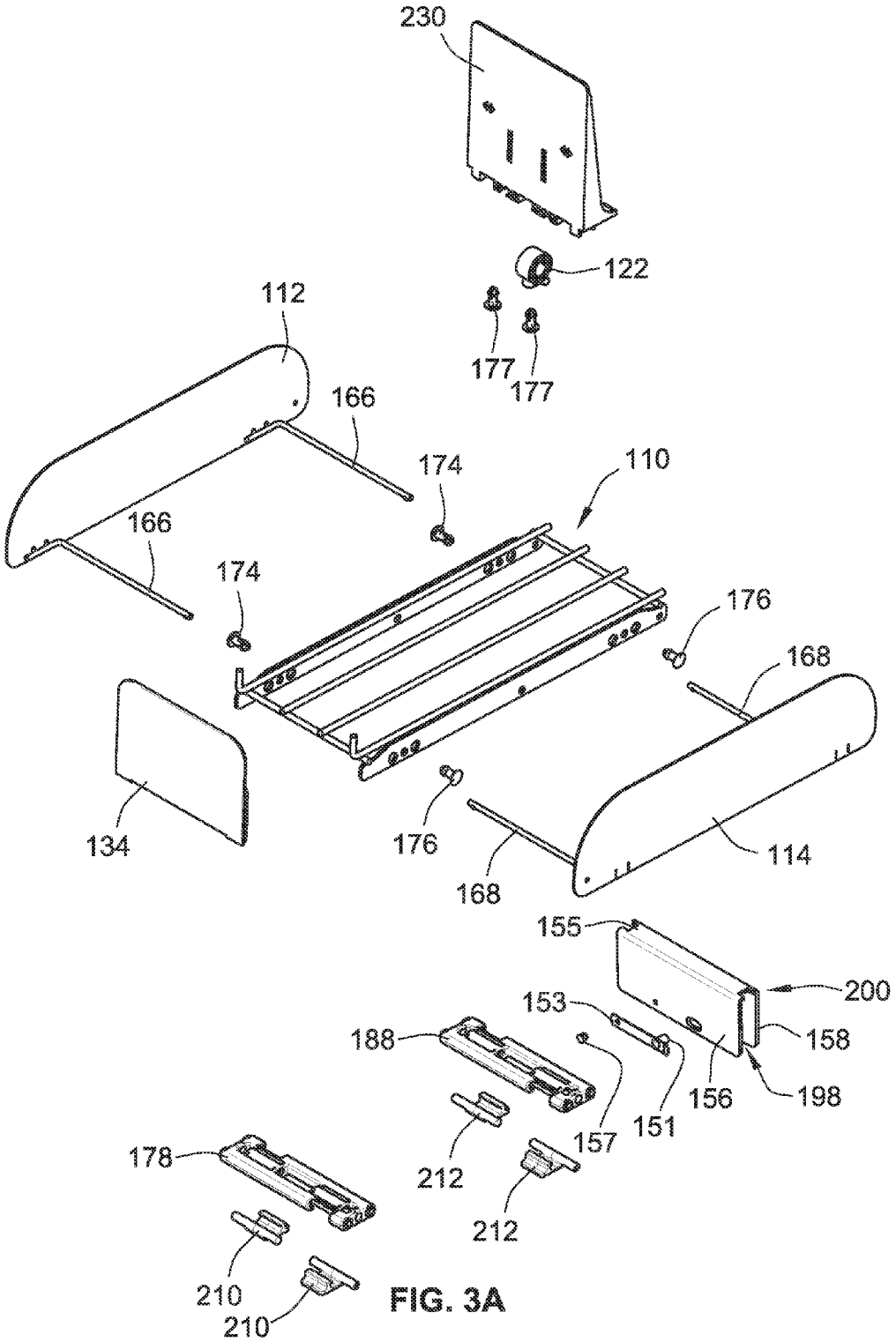
FIG. 3A is an exploded perspective view of the tray of FIG. 1.
Figure 3B:
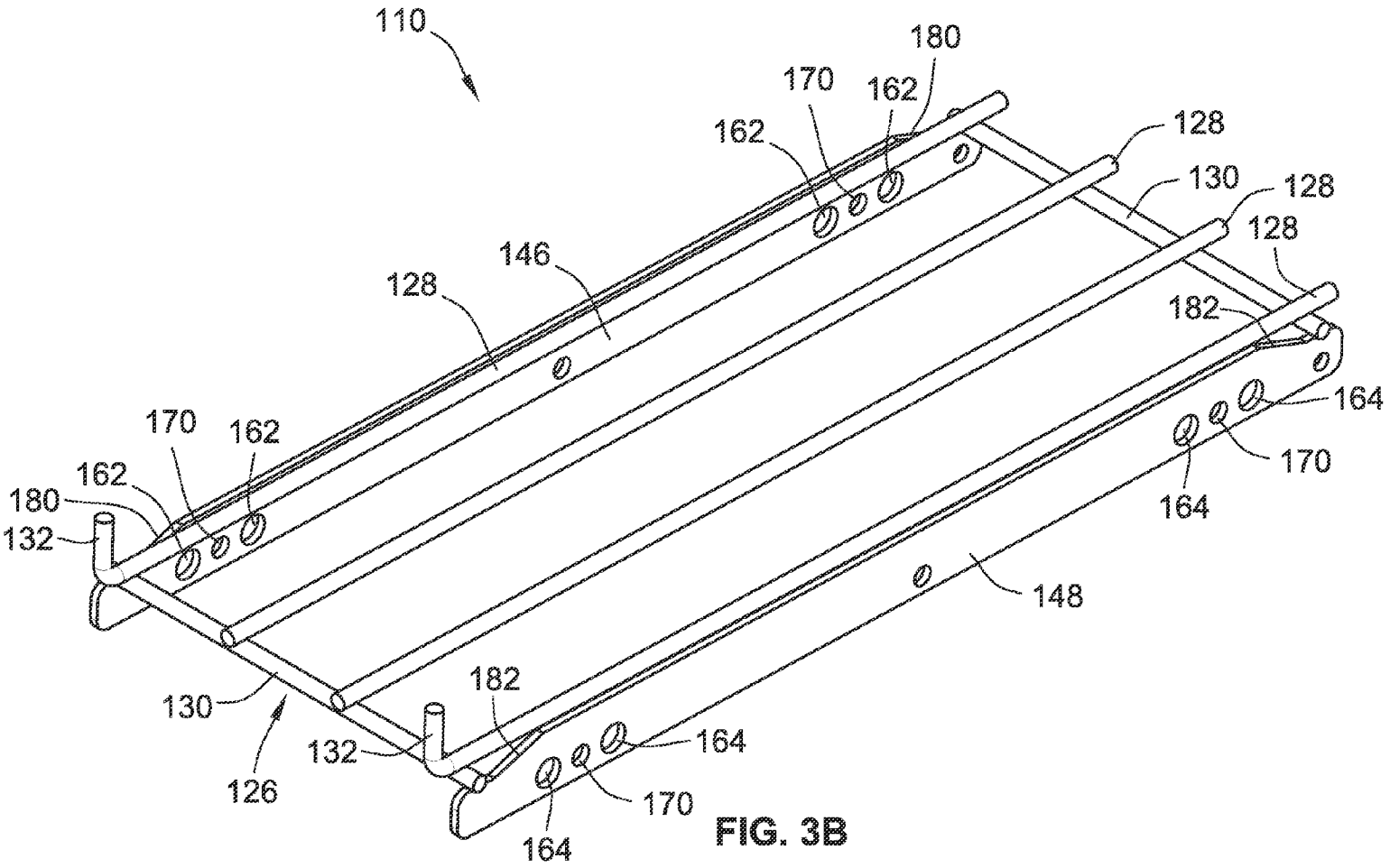
FIG. 3B is a close up perspective view of the base structure of FIG. 1.

Turning now to FIGS. 3A-B, with particular attention to the base structure 110. The base structure 110 can be composed of a wire floor 126, which incorporates a plurality of longitudinal members 128 and a plurality of transverse members 130. Typically, the longitudinal members 128 and the transverse members 130 are welded together to form the wire floor 126. One of ordinary skill in the art will readily recognize that the number of longitudinal members 128 or transverse members 130 is not limited to the illustrations and fewer or greater numbers of each may readily be incorporated into other embodiments governed by this application. Likewise, one of ordinary skill in the art will recognize that any coupling means generally known in the art can be used to couple the longitudinal members 128 to the transverse members 130. The pusher 116 can slidably engage one or more of the longitudinal members 128 of the wire floor 126 to facilitate movement thereupon.

As best illustrated in FIG. 3B, the two outer-most longitudinal members 128 can have upturned ends 132. The upturned ends 132 can receive a front stop 134, as illustrated in FIG. 3A. As illustrated in FIGS. 1-2, the front stop 134 serves as the forward boundary of the retail merchandise channel and prevents the retail merchandise 104 from shifting any further forward once the retail merchandise 104 abuts the front stop 134. As will be appreciated by one of ordinary skill in the art, the front stop 134 can take on a variety of sizes or shapes to accommodate for different applications of the invention. Thus, the particular size or shape of the front stop 134 is not limiting upon the invention. Likewise, it will be appreciated by one of ordinary skill in the art that the front stop 134 is interchangeable with other front stops having a variety of shapes or sizes. It will be appreciated that exchanging the front stop 134 for another front stop simply requires removing the front stop 134 from the upturned end 132 of the wire frame 126 and replacing the front stop 134 with a different front stop of the users choosing.

As best illustrated in FIG. 3B, the base structure 110 has first and second support structures 146 and 148. The first and second support structures 146 and 148 each have respective apertures 162 and 164. The apertures 162 and 164 receive the first and second extensions 166 and 168 respectively of the first and second dividers 112 and 114, as best illustrated in FIG. 3A. In addition, each support structure 146 and 148 includes respective apertures 170 to receive fasteners 174 and 176 respectively, as best illustrated in FIG. 3A. As will be described in detail below, the fasteners 174 and 176 fixedly retain the front and rear spacers 178 and 188, which maintain the spacing of the support structures 146 and 148. Furthermore, as illustrated in FIG. 3B the support structures 146 and 148 have respective tapered ends 180 and 182 that receive and hold the front and rear transverse members 130 of the wire floor 126. Thus, the support structures 146 and 148, by way of the tapered ends 180 and 182, support the wire floor 126.

Figure 4:
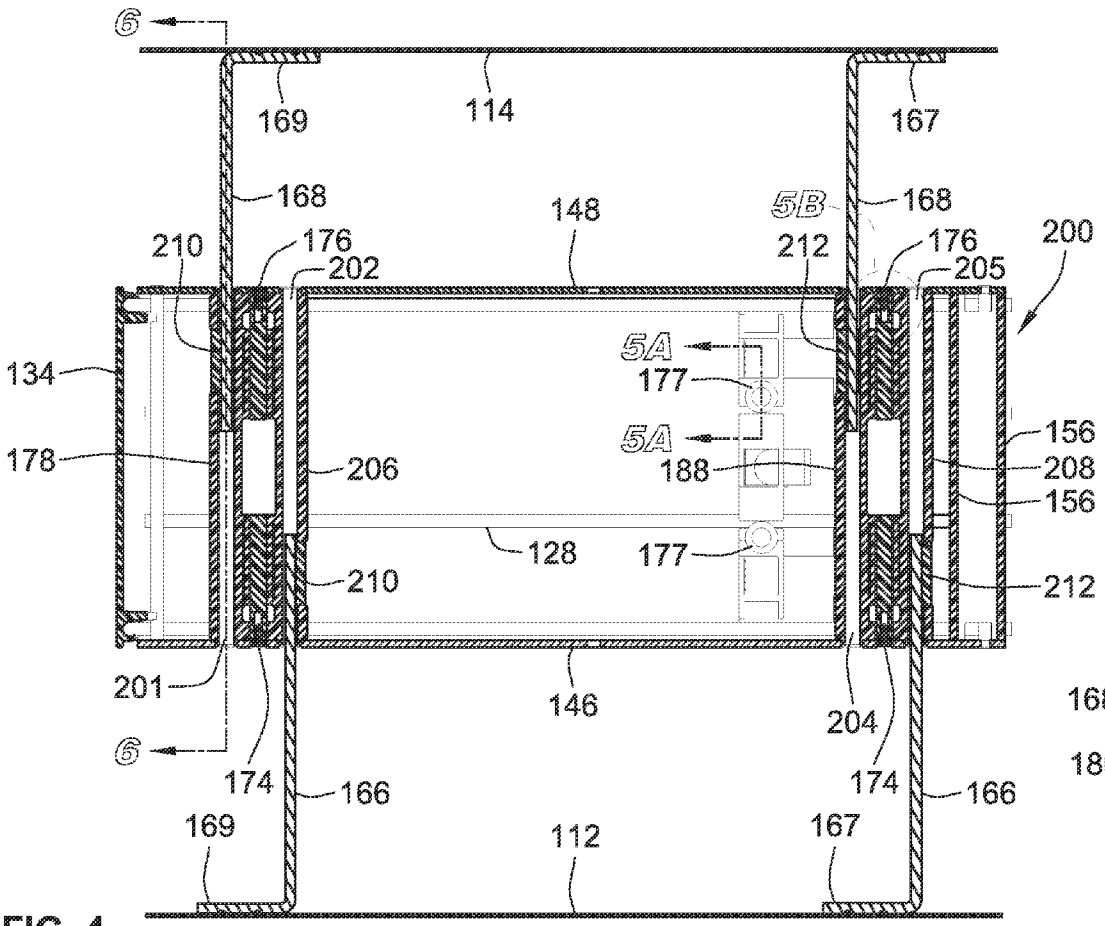
FIG. 4 is a bottom cross section of the tray of FIG. 1.

Turning to FIG. 4, a top cross-section of the base structure 110 and the mounted configuration of the front and rear spacers 178 and 188 are illustrated. As can be seen, each spacer 178 and 188 receive extensions 166 and 168 of the dividers 112 and 114. Running through the body 206 of the front spacer 178 are generally parallel bores 201 and 202. Likewise, the rear spacer 188 has generally parallel bores 204 and 205. The front spacer 178 receives respective extensions 166 and 168 in bores 202 and 201. Likewise, the rear spacer 188 receives respective extensions 166 and 168 in bores 205 and 204.

Further, each spacer 178 and 188 incorporates respective clips 210 and 212. Clips 210 mount to the front most spacer 178. A first end of clip 210 contacts the body 206 of the spacer 178, while a second end of clip 210 contacts extension 168. This contact produces a bearing load against the extension 168 to generally hold the extension 168 in its adjusted position within spacer 178, and more particularly within bore 201. Likewise, at one end of the other clip 210 contacts body 206 of spacer 178, while the second end of clip 210 contacting extension 166 at the other end of clip 210, which produces a bearing load against extension 166 to hold it in its adjusted position within bore 202.

For brevities sake, it is recognized that clips 212 mounted to spacer 188 perform in a similar manner as described relative to clips 210. Furthermore, although clips 210 and 212 are illustrated making contact with the spacers 178 and 188 respectively, along with making contact with extensions 166 and 168 respectively, other embodiments can incorporate clips that are removable components.

Figure 5A:
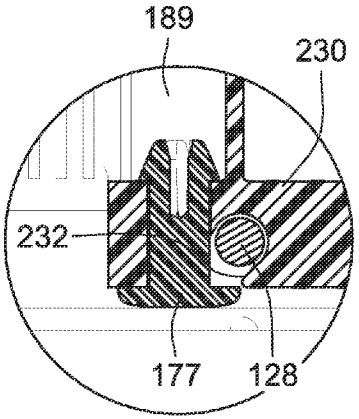
FIG. 5A is a partial view of the cross section of FIG. 4.

Turning to FIG. 5A, which illustrates a close up cross section of linear motion bearing 177 vertically extending from the pusher body 230, and a longitudinal member 128 of the wire floor 126. The pusher 230 has an aperture 189, whereby linear motion bearing 177 is inserted to mechanically couple to the pusher body 230. The pusher body 230 further comprises aperture 232 for receiving and retaining a longitudinal member 128 of the wire floor 126. As the aperture 232 retains the longitudinal member 128 the pusher body 230 is positioned to create a slidable interface between the linear motion bearing 177 and the longitudinal member 128. The slidable interface between the linear motion bearing 177 and the longitudinal member 128 allows the pusher body 230 to slide along the longitudinal member 128 on a first axis 120 relative to the base structure 110 (see FIG. 2), while preventing movement along a second axis 121 relative to the base structure (see FIG. 2).

Figure 5B:
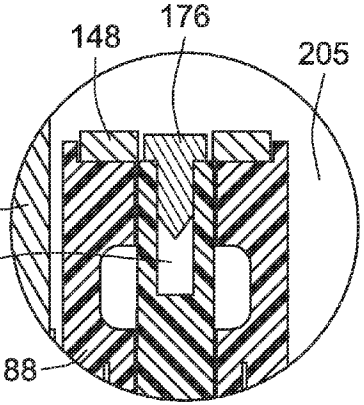
FIG. 5B is a second partial view of the cross section of FIG. 4.

Turning now to FIG. 5B, which illustrates the connection between support structure 148 and spacer 188. As illustrated, the spacer 188 has an aperture 186 that accepts fastener 176. A coupling is formed when the aperture 186 of the spacer 188 is aligned with the aperture 170 of support structure 148 (see FIG. 3B) and the fastener 176 is inserted through aperture 170 of the support structure 148 and the aperture 186 of the spacer 188. One of ordinary skill in the art will recognize that spacer 188 is connected to support structure 146 using fastener 174 in the same manner as described above. Likewise, support structure 146 and 148 are each respectively coupled to spacer 178 in the same manner using respective fasteners 174 and 176.

Figure 6:
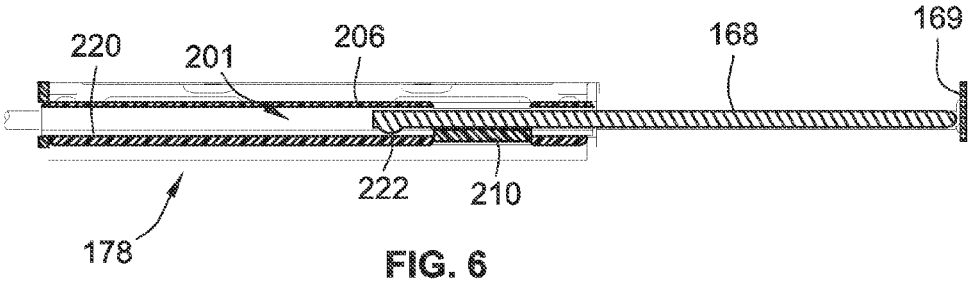
FIG. 6 is a partial front cross section of FIG. 4.

Turning to FIG. 6, showing a cross-section of spacer 178 and extension 168 extending through bore 201 of the spacer body 206. Bore 201 includes a keyway 220 that permits the passage of key 222 that is formed at the terminal end of extension 168. As illustrated, clip 210 does not incorporate keyway 220 to permit the passage of key 222. In use, when key 222 abuts the innermost edge of clip 210 it prevents any further passage from left to right of extension 168 or outturned edge 169. Likewise, the innermost edge of clip 210 also prevent any further movement of divider 114 along axis 121 (see FIG. 2) because outturned edge 169 is coupled to divider 114. This configuration prevents extension 168 and divider 114 from inadvertently dislodging from the spacer 178. Although not illustrated, a similar configuration is provided in bore 202 of spacer 178 to prevent the inadvertent dislodgement of extension 166 and divider 112. Likewise, rear spacer 188 employs a like configuration in respective bores 204 and 205 to prevent the inadvertent dislodgement of extensions 166 and 168 and respective dividers 112 and 114.

Figure 7:
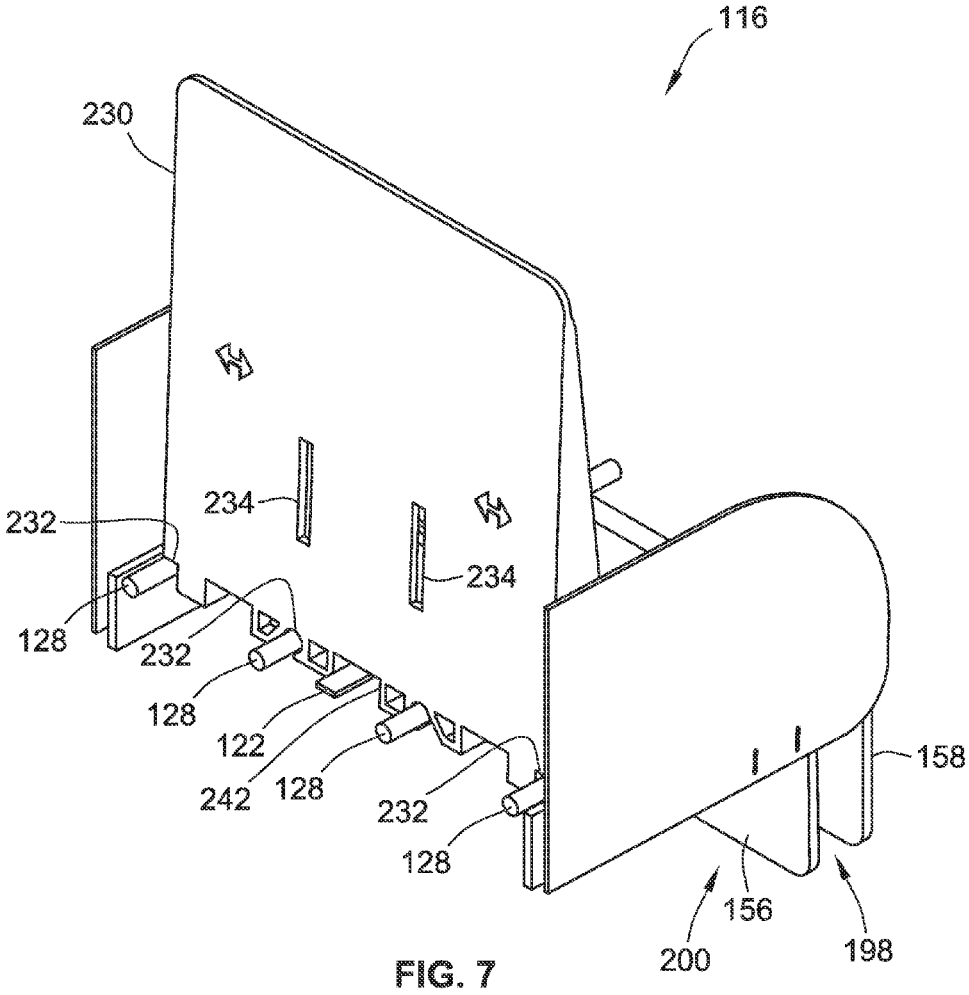
FIG. 7 is a front cross section of the tray of FIG. 1.

Turning to FIG. 7, which further illustrates the details of the pusher 116. The pusher body 230 takes the shape of a generally upright paddle. The bottom edge of the pusher body 230 has a plurality of notches 232 for receiving longitudinal members 128. The notches 232 allow the pusher body 230 to slide along longitudinal members 128 by way of the linear bearing member 177, as best illustrated in FIG. 4. As illustrated in FIG. 7, the innermost notches 232 have a generally curved shape on the pusher body 230 and the outermost notches 232 form a generally right angle cut out on the pusher body 230. The pusher body 230 also carries the biasing mechanism (hereinafter "spring") 122. Those of skill in the art will appreciate that the pusher body 230 is interchangeable with pusher bodies having a variety of shapes and sizes, whereby a single tray can accommodate retail merchandise having a variety of shapes or sizes.

Figure 8:
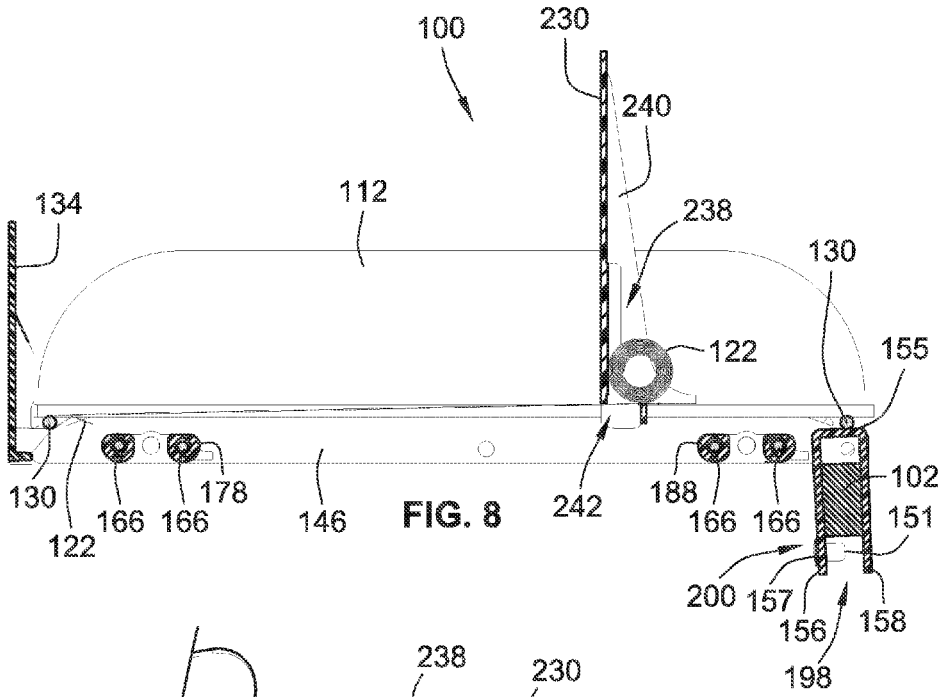
FIG. 8 is a side cross section of the tray of FIG. 1.

Turning now to FIG. 8, which illustrates a cross section of the tray 100. As illustrated, the first support structure 146 couples to support bracket 200. The first and second support structures 146 and 148 are typically coupled to the support bracket 200 by welding, or more specifically gas metal arc welding. As will be appreciated by those of skill in the art, welding of the first and second support structures 146 and 148 to the support bracket 200 has many advantages, such as providing a mechanically strong coupling, being relatively inexpensive, and does not require the use of excess components which can be expensive to manufacture and easily loosened or lost. However, one of ordinary skill in the art will recognize that the first and second support structures 146 and 148 may be coupled by any means known in the art. It should also be appreciated that the second support structure 148 couples to the support bracket 200 in the same manner as the first support structure 146.

Figure 9:
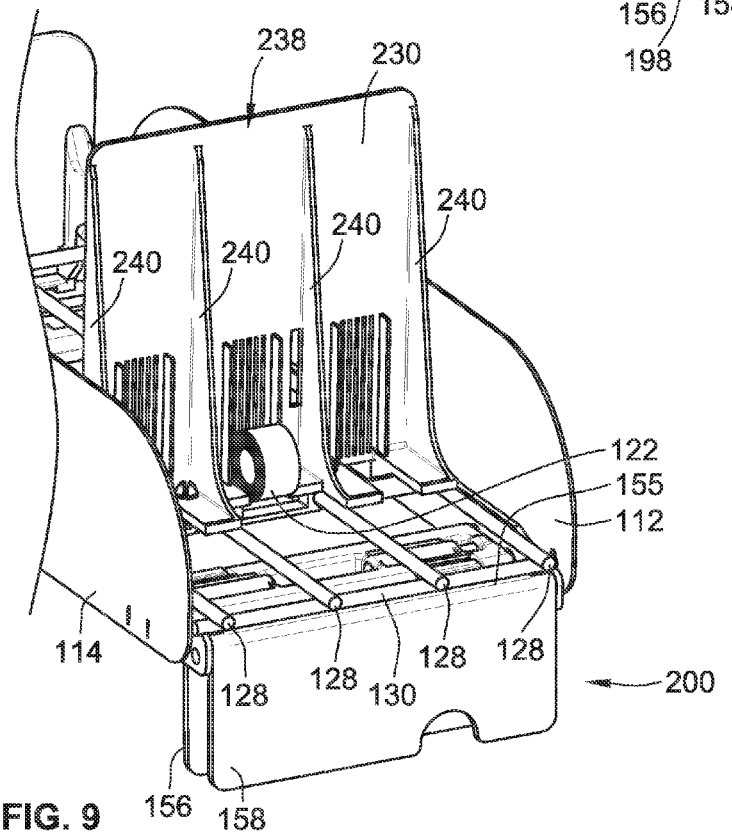
FIG. 9 is a partial top perspective view of the tray of FIG. 1.

Turning to FIG. 9, the internal cavity 238 of the pusher body 230 carries spring 122. The pusher body 230 has generally vertical support walls 240 that surround the internal cavity 238 and provide support to the pusher body 230. As illustrated at FIG. 8, spring 122 is generally a coil spring that extends from internal cavity 238 through opening 242 in the pusher body 230 and terminates at the front most horizontal member 130 of wire floor 126. One of skill in the art will recognize that in other embodiments the spring 122 can couple to other elements of the tray 100, such as the front stop 134, etc.

As illustrated in FIGS. 10-12A-D, the support bracket 200 has a horizontal top plate 155 in which a first and second sidewall 158 and 156 depend. The horizontal top plate 155 and the first and second sidewall 158 and 156 form a downwardly opening notch 198.

Figure 10:
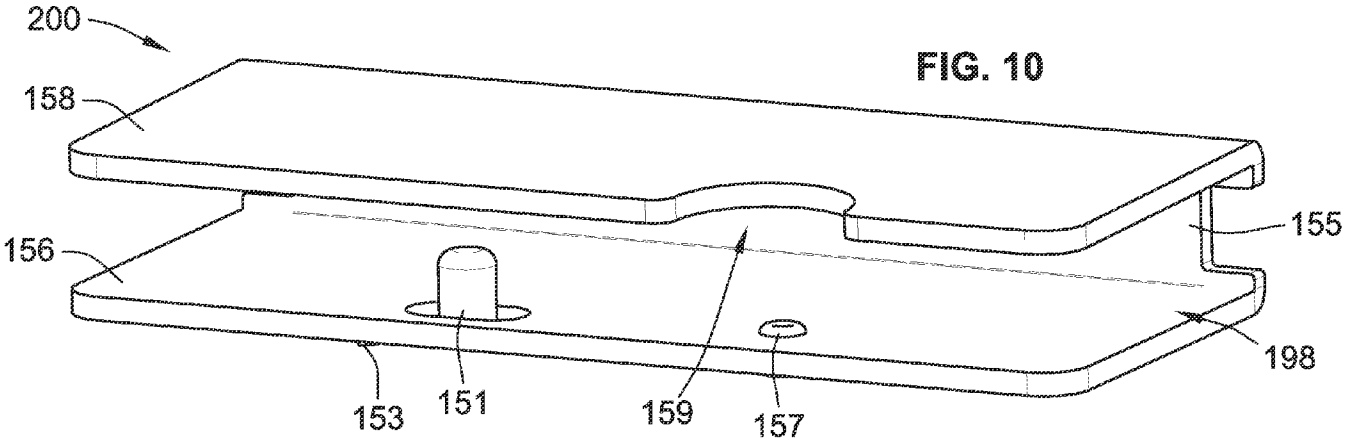
FIG. 10 is a first perspective view the support bracket.
Figure 11:
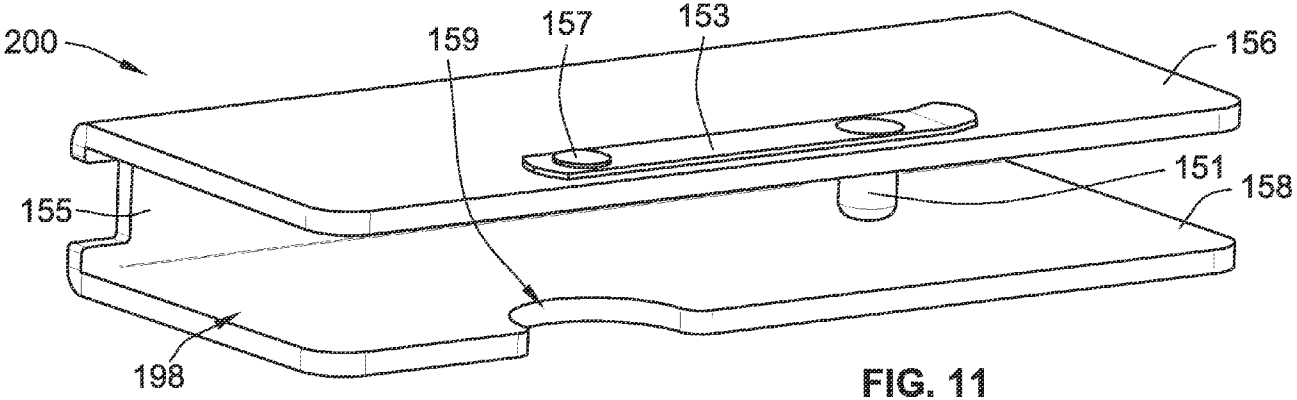
FIG. 11 is a second perspective view of the support bracket of FIG. 10.
Figures 12A, 12B, 12C:
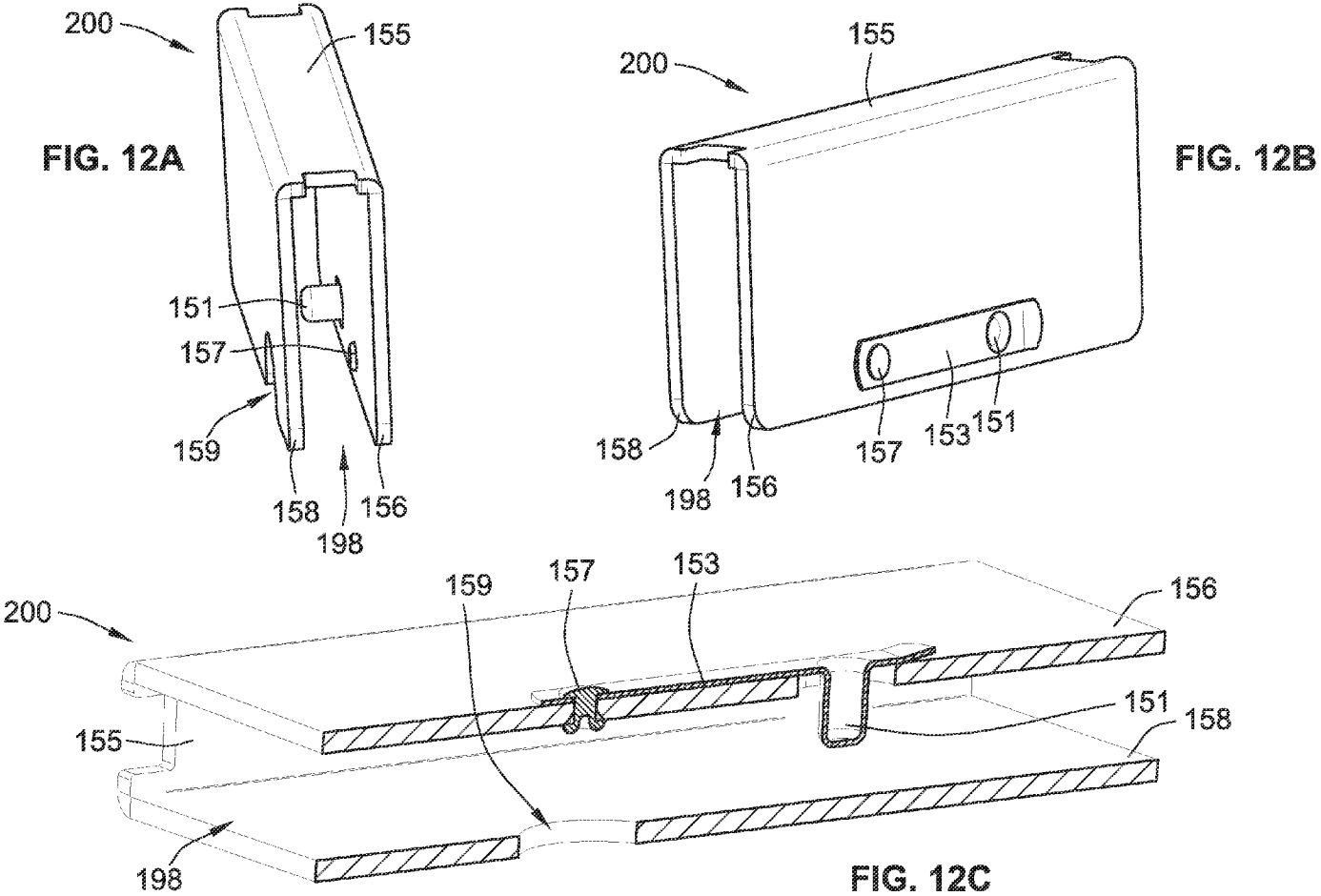
FIG. 12A is a side perspective view of the support bracket of FIG. 10.
FIG. 12B is a perspective view of the hindmost sidewall of the support bracket of FIG. 10.
FIG. 12C is a cross sectional perspective view of the support bracket of FIG. 10.
Figure 12D:
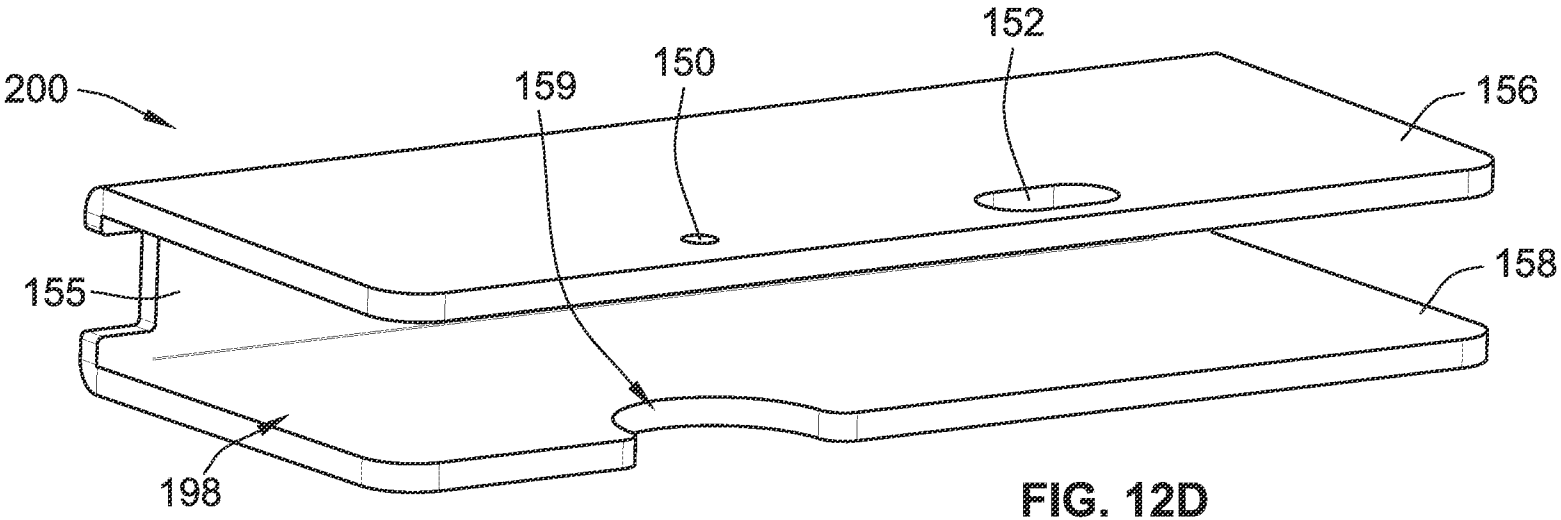
FIG. 12D is a perspective view of the support bracket of FIG. 10 with the locking bar removed.

As best illustrated in FIGS. 10-11, the second sidewall 158 has an aperture 159 that provides access to a locking button 151. As best illustrated in FIG. 11, the locking button 151 and rivet 157 are a part of the locking bar 153. As best illustrated in FIG. 12C, the locking button 151 projects through a first aperture 152 in the first sidewall 156 and into the downwardly opening notch 198 of the support bracket 200. The rivet 157 projects through the locking bar 153 and a second aperture 150 in the first sidewall 156 where the rivet 157 secures the locking bar 153 to the support bracket 200.

To attach the support bracket 200 to a retail display bar 102 (see FIG. 1) the user applies linear force to the locking button 151. As the user applies linear force to the locking button 151 the external load perpendicularly applies to the longitudinal axis of the locking bar 153 which will eventually cause the locking bar 153 to flex. The rivet 157 acts to secure the locking bar 153 to the first sidewall 156 while the linear force applied to the locking button 151 causes the locking bar 153 to flex under the external load perpendicularly applied to the axis of the locking bar 153. When enough force is applied to the locking button 151, it will move partially through aperture 152 and provide a clearance for a retail display bar 102 to enter the downwardly opening notch 198 and make contact with the horizontal top plate 155 of the support bracket 200.

Once the retail display bar 102 is positioned within the support bracket 200, the user releases the locking button 151, which in turn releases the external load perpendicularly applied to the axis of the locking bar 153. As the external load perpendicularly applied to the axis of the locking bar 153 is released it causes the locking bar 153 to flex back into its original position, which forces the locking button 151 back through aperture 152. When the locking button 151 projects through aperture 152 into the downwardly opening notch 198 it closes of the clearance that allowed the retail display bar 102 to enter the downwardly opening notch 198, thereby locking the retail display bar 102 therein. It will be recognized by one of ordinary skill in the art that a similar technique will allow the user to easily release the support bracket 200 from the retail display bar 102. Likewise, those of skill in the art will appreciate that the locking bar 153 is preferably made from a strong yet flexible material such hot-rolled steel, cold-rolled steel, galvanized steels or an aluminum alloy.

Turning now to FIG. 13, illustrating tray 300, which is a second embodiment governed by this application. This embodiment is similar to tray 100 described above with the exception that the tray 300 incorporates wire side dividers 312 and 314 instead of the solid side dividers 112 and 115, best illustrated in FIG. 2. The second embodiment also includes a pusher 316 of the type discussed in detail above. Furthermore, a first and second divider 312 and 314 and the pusher 316 are mounted to the base structure 310. Furthermore, tray 300 also incorporates respective extensions 366 and 368 like extensions 166 and 168 discussed in detail above. Tray 300 also incorporates support bracket 400 that is the same as support bracket 200 as previously discussed. Likewise, the first and second divider 312 and 314 and the pusher 316 are moveable relative the base structure 310 as discussed in detail above. Additionally, this embodiment also incorporates an integrated label holder 336 that attaches to the front stop 334 of tray 300. As will be readily recognized by one of ordinary skill in the art, the integrated label holder 336 can be incorporated with all of the embodiments described herein.

Figure 14:
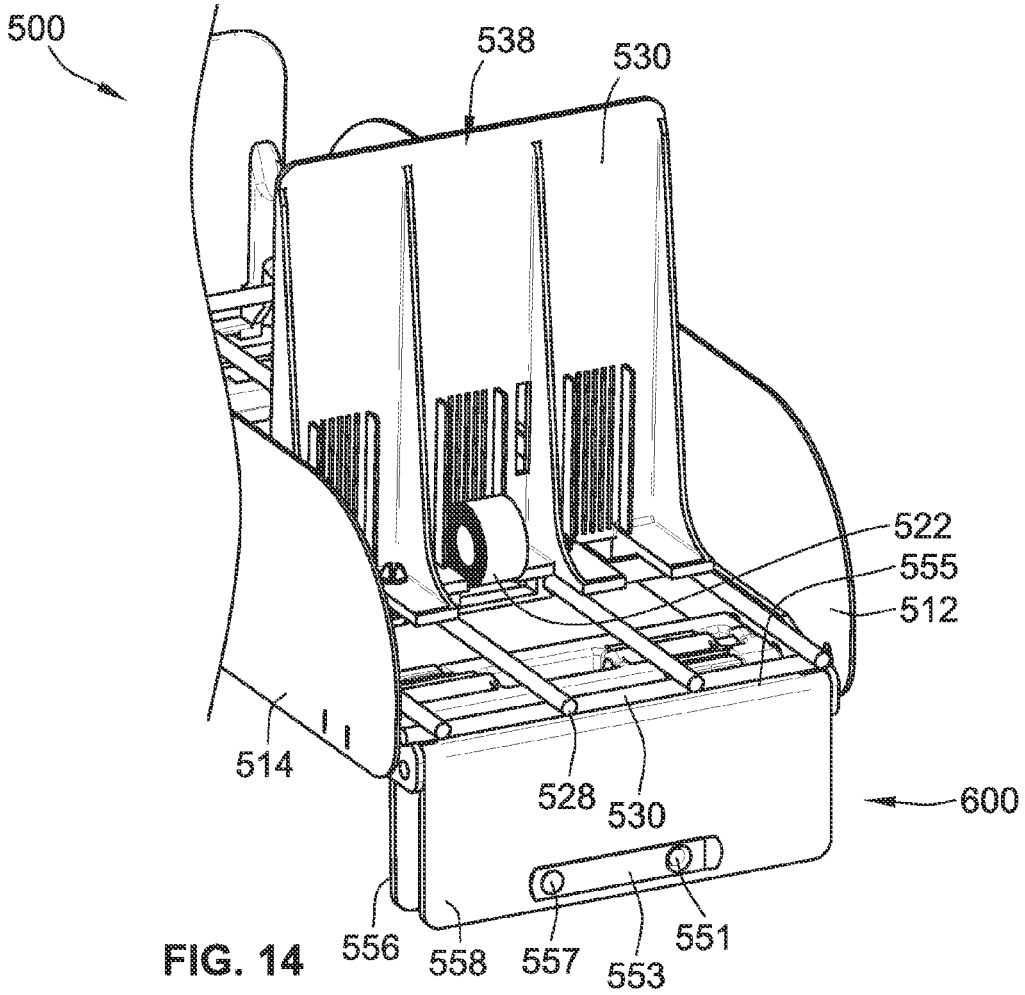
FIG. 14 is a partial perspective view of a third embodiment of a merchandise pusher tray according to the teachings of the present invention.

Turning to FIG. 14, illustrating tray 500, which is a third embodiment governed by this application. Tray 500 is similar to the tray 100 described above in that it has a first and second divider 512 and 514, longitudinal members 528 and the transverse members 530, spring 522, and a pusher body 530 having an internal cavity 538. Tray 500 differs from tray 100 in that tray 500 incorporates a support bracket 600 that is rotated 180 degrees relative to the support bracket 200 of tray 100. As can be seen the support bracket 600 has a first sidewall 556 and a second sidewall 558 and a horizontal top plate 555. However, unlike tray 100 the second sidewall 558 houses the locking bar 553 including the locking button 551 and rivet 557. For brevities sake, one of skill in the art will recognize that tray 500 including support bracket 600 operate in a similar fashion as tray 100 described in detail above with the exception that the user will apply linear force to the locking button 551 in a direction towards the second sidewall 558 when positioning the support bracket 600 to hang the tray 500 onto a retail display bar 102 (see FIG. 1) as well as when the user is releasing the support bracket 600 and removing the tray 500 from a retail display bar 102.

Although not illustrated, all of the embodiments described herein can omit the movable dividers 112 and 114, 312 and 314, or 512 and 514 and still achieve the various advantages described herein. Likewise, all of the embodiments can omit a single moveable divider 112, 114, 312, 314, 512, or 514 if needed, such as when tray 100, tray 300, or tray 500 abuts against a wall, and still achieve the various advantages described herein. Further, the embodiments illustrated in FIG. 13 and FIG. 14 incorporate all of the features of the embodiment described in FIGS. 1-12, with the exception of the differences identified in the preceding.

As described herein, embodiments of the present invention provide a new and improved solution to existing pusher systems given that the invention may be readily incorporated in a commercial refrigerated or freezer-type display. Further, embodiments of the present invention provide for enhanced mounting capabilities that allow retailers to use the limited space in retail refrigerators and freezers to display retail merchandise.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A merchandise pusher tray, comprising:

a base structure including a first support structure and a second support structure arranged in an opposed spaced relationship;

wherein the first and second support structures provide a retail merchandise support surface configured to carry retail merchandise thereon;

a pusher interposed between the first and second support structure;

wherein the pusher is moveable relative to the base structure along a first axis;

a first divider mounted to the base structure;

a single support bracket positioned at an end of the base structure, the support bracket defining a downwardly facing opening; and wherein the downwardly facing opening is at least partially situated below the retail merchandise support surface and configured to receive a retail display bar.

2. The tray of claim 1, wherein the base structure includes a floor carried by the first and second support structures;

wherein the floor defines a support surface configured to carry retail merchandise thereon.

3. The tray of claim 2, wherein the floor is a welded wire assembly;

wherein the welded wire assembly includes a plurality of longitudinal wires and a plurality of transverse wires joined to each of the plurality of longitudinal wires.

4. The tray of claim 3, wherein at least one of the plurality of longitudinal wires includes an up-turned end for receiving a front stop.

5. The tray of claim 1, wherein the first and a second divider are arranged in an opposed spaced relationship to define a retail merchandise channel;

wherein the retail merchandise channel has a variable width based upon an adjusted position of the first and the second divider wherein the width of the retail merchandise channel is variable in a direction perpendicular to a direction of movement of the pusher.

6. The tray of claim 5, wherein the first and the second divider include a first and a second extension;

wherein the first and the second extension extend from the first and second divider into the base structure.

7. The tray of claim 6, wherein the first and the second extension of the first and the second divider extend into a first and a second spacer respectively;

wherein the first and the second spacer are mounted to the base structure between the first and the second support structures.

8. The tray of claim 1, wherein the support bracket has a horizontal top plate from which a first and a second sidewall depend.

9. A merchandise pusher tray, comprising:

a base structure including a first and a second support structure arranged in an opposed spaced relationship;

a pusher slidably mounted to the base structure; and a first and a second divider;

wherein the first and the second divider are moveable to define a width of a merchandise-retaining channel;

wherein the first and the second support structures are coupled to a single support bracket having a horizontal top plate;

wherein the horizontal top plate does not extend beyond the first and second support structures;

wherein the support bracket defines a channel configured for receiving a retail display bar.

10. The tray of claim 9, wherein the base structure has a wire floor;

wherein the wire floor has a plurality of longitudinal members and a plurality of transverse members.

11. The tray of claim 10, wherein the plurality of longitudinal members are welded to the plurality of transverse members.

12. The tray of claim 10, wherein at least one linear motion bearing extends from the base of the pusher;

wherein the pusher has at least one aperture running parallel to at least one longitudinal member;

wherein the aperture retains the longitudinal member;

wherein a slidable interface is created between the linear motion bearing and the longitudinal member.

13. The tray of claim 12, wherein the linear motion bearing is moveable along a first axis relative to the base structure.

14. A merchandise pusher tray, comprising:

a base structure including a first and a second support structure arranged in an opposed spaced relationship;

wherein the first and the second support structures provide a surface to carry retail merchandise thereon;

wherein a pusher is slidable along a first axis of the surface;

wherein the first and second support structures couple to a support bracket;

wherein the support bracket has a horizontal top plate in which a first and a second sidewall depend wherein the support bracket has a removable locking bar;

wherein the locking bar couples to the first sidewall;

wherein the locking bar has a locking button and;

wherein the first sidewall has a first and second aperture extending through the first sidewall.

15. The tray of claim 14, wherein the locking button partially projects through the first aperture;

wherein a rivet secures the locking bar to first sidewall through the second aperture.

16. The tray of claim 14, wherein the second sidewall has an aperture;

wherein the aperture is located opposite the rivet, whereby a user can access the locking button through the aperture.

17. The tray of claim 14, wherein the support bracket mounts to a generally vertical wall and holds the base structure;

wherein the base structure is held as a cantilevered extension.

18. The tray of claim 14, wherein the first and second support structures are welded to the support bracket.

19. The tray of claim 17, wherein a biasing mechanism is operatively connected to a pusher body;

wherein the biasing mechanisms permit biasing of the pusher.

20. The tray of claim 19, wherein the biasing mechanism is a coiled spring.

21. The tray of claim 20, wherein the coiled spring further includes a first end that releasably engages a front stop and a second coiled end that abuts the pusher.

* * * * *